US008585385B2

(12) United States Patent
Watanabe

(10) Patent No.: US 8,585,385 B2
(45) Date of Patent: Nov. 19, 2013

(54) REFRIGERANT COMPRESSOR AND REFRIGERATING CYCLE DEVICE

(75) Inventor: Norihisa Watanabe, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 396 days.

(21) Appl. No.: 12/933,452

(22) PCT Filed: Mar. 6, 2009

(86) PCT No.: PCT/JP2009/054263

§ 371 (c)(1),
(2), (4) Date: Sep. 20, 2010

(87) PCT Pub. No.: WO2009/116405

PCT Pub. Date: Sep. 24, 2009

(65) Prior Publication Data

US 2011/0052439 A1 Mar. 3, 2011

(30) Foreign Application Priority Data

Mar. 21, 2008 (JP) ..... 2008-074607

(51) Int. Cl.

| | |
|---|---|
| ***F01C 21/00*** | (2006.01) |
| ***F01C 1/30*** | (2006.01) |
| ***B32B 15/04*** | (2006.01) |
| ***B21D 39/00*** | (2006.01) |

(52) U.S. Cl.

USPC ..... 418/178; 418/11; 418/179; 428/623; 428/627

(58) Field of Classification Search

USPC ..... 418/178, 179, 11, 60, 63; 428/627, 623, 428/634, 472, 408, 698

See application file for complete search history.

(56) References Cited

U.S. PATENT DOCUMENTS 4,267,064 A * 5/1981 Sasaki et al. ..... 508/304
6,299,425 B1 * 10/2001 Hirano et al. ..... 418/63

FOREIGN PATENT DOCUMENTS

JP 63-262467 10/1988
JP 63-286334 11/1988

(Continued)

OTHER PUBLICATIONS

English Language Abstract of JP 2007 032360 published Feb. 8, 2007.

(Continued)

*Primary Examiner* — Theresa Trieu
*Assistant Examiner* — Laert Dounis
(74) *Attorney, Agent, or Firm* — DLA Piper LLP (US)

(57) ABSTRACT

A refrigerant compressor includes a first layer (24) composed of a single layer of chromium, a second layer (25) composed of an alloy layer of chromium and tungsten carbide, a third layer (26) composed of an amorphous carbon layer containing at least one of tungsten and tungsten carbide, and a fourth layer (27) composed of an amorphous carbon layer containing carbon and hydrogen without metals, which are sequentially formed on a surface of a sliding member (13*b*) of a compression mechanism formed of tool steel. The second layer (25) is formed to have a chromium content higher on a side of the first layer (24) than a side of the third layer (26), and have a tungsten carbide content higher on the side of the third layer (26) than the side of the first layer (24). In addition, the third layer (26) is formed to have a tungsten content or a tungsten carbide content higher on a side of the second layer (25) than a side of the fourth layer (27).

8 Claims, 6 Drawing Sheets

(56) References Cited

FOREIGN PATENT DOCUMENTS

| | | | |
|---|---|---|---|
| JP | 5-202477 | | 8/1993 |
| JP | 2007-032360 | | 2/2007 |
| JP | 2007032360 A | * | 2/2007 |

OTHER PUBLICATIONS

English Language Translation of JP 2007 032360 published Feb. 8, 2007.

International Search Report issued in PCT/JP2009/054263 on Jun. 9, 2009.

English Abstract of JP 5-202477 published Aug. 10, 1993.

English Translation of JP 5-202477 published Aug. 10, 1993.

English Abstract of JP 63-262467 published Oct. 28, 1988.

English Abstract of JP-63286334 published Nov. 24, 1988.

* cited by examiner

REFRIGERANT COMPRESSOR AND REFRIGERATING CYCLE DEVICE

TECHNICAL FIELD

The present invention relates to a refrigerant compressor and a refrigerating cycle device. More specifically, the present invention relates to a refrigerant compressor and a refrigerating cycle device that include a sliding member having coated layer with high abrasion resistance and adhesiveness.

BACKGROUND ART

A refrigerating cycle device has been applied to an air conditioner for heating or cooling a room, and a refrigerating unit such as a refrigerator and a refrigerating showcase. Recently, the refrigerating cycle device has been also applied to a heat pump water heater. Such a refrigerating cycle device includes a refrigerant compressor to be built therein, and circulates an HFC system refrigerant, an HC system refrigerant, a natural refrigerant such as $CO_2$, or the like.

A refrigerant compressor described in PTL 1 has been known. This conventional refrigerant compressor houses an electric motor and a compression mechanism connected to the electric motor via a rotating shaft in a sealed case. The compression mechanism is provided with a cylinder in which an eccentric roller is arranged, and a front edge of a vane as a sliding member is elastically brought into contact with a periphery of the eccentric roller. When the eccentric roller is driven and rotated by the electric motor, the eccentric roller and the vane slide relative to each other.

In such a case, a coated layer including an amorphous carbon layer is formed on a surface of the vane in order to prevent the surface of the vane from being abraded due to the sliding of the eccentric roller and the vane.

In addition, the conventional refrigerant compressor described in PTL 1 is provided with the amorphous carbon layer as a coated layer formed on a surface of a single-layer or double-layer vane. When the amorphous carbon layer has a double-layered structure, a lower layer (at a base material side) is an amorphous carbon layer containing hydrogen, and an upper layer is an amorphous carbon layer containing metals.

Moreover, a nitride layer is formed on a surface of the base material of the vane, an intermediate layer is formed on the nitride layer, and the amorphous carbon layer is formed on the intermediate layer. The nitride layer and the intermediate layer are formed so that a hardness difference between the base material and the amorphous carbon layer is gently changed. As a result of reducing the hardness differences between the nitride layer and the intermediate layer and between the intermediate layer and the amorphous carbon layer, adhesiveness therebetween is improved. Accordingly, the amorphous carbon layer is prevented from being delaminated from the surface of the vane.

CITATION LIST

Patent Literature

[PTL 1] Japanese Patent Laid-Open Publication No. 2007-032360.

SUMMARY OF INVENTION

In the vane of the conventional refrigerant compressor described in PTL 1 as described above, the nitride layer is formed on the surface of the base material of the vane, on which the intermediate layer and the amorphous carbon layer are further formed.

Meanwhile, the nitride layer, the intermediate layer, and the amorphous carbon layer are formed by different processes, respectively. Therefore, in order to sequentially form those layers, a processing furnace and processing program corresponding to such a sequential process are required. Consequently, a manufacturing condition is restricted, and as a result, the cost has been high.

In addition, when the nitride layer is provided with a nitrogenous compound layer on its surface, adhesiveness is highly reduced. Thus, only a diffusion layer is provided on the surface of the nitride layer. A method of providing only the diffusion layer on the surface of the nitride layer includes a method by removing the nitrogenous compound layer, or a method without producing the nitrogenous compound layer by a nitriding treatment. When the nitrogenous compound is removed, component accuracy is difficult to be maintained, which results in reduction of a yield rate due to processing loss. Meanwhile, when the nitrogenous compound layer is not produced by the nitriding treatment, surface roughness of the base material of the vane is deteriorated due to nitridation, which also results in deterioration of surface roughness of the amorphous carbon layer.

The present invention has been made in consideration for the above-mentioned problem. An object of the present invention is to prevent the amorphous carbon layer from being delaminated by having a low-cost structure as a whole when the amorphous carbon layer is formed on the surface of the sliding member of the refrigerant compressor.

A first aspect of the present invention provides a refrigerant compressor comprising a compression mechanism that compresses a refrigerant used in refrigerating cycle, wherein at least one of sliding members in the compression mechanism is formed of tool steel. A first layer composed of a single layer of chromium, a second layer composed of an alloy layer of chromium and tungsten carbide, a third layer composed of a metal-containing amorphous carbon layer containing at least one of tungsten and tungsten carbide, and a fourth layer composed of an amorphous carbon layer containing carbon and hydrogen without metals are sequentially formed on a surface of the sliding member formed of the tool steel. In this case, the second layer is formed to have a chromium content higher on a side of the first layer than a side of the third layer, and have a tungsten carbide content higher on the side of the third layer than the side of the first layer. In addition, the third layer is formed to have a tungsten content or a tungsten carbide content higher on a side of the second layer than a side of the fourth layer.

A second aspect of the present invention provides a refrigerating cycle device, comprising: the refrigerant compressor according to the first aspect of the present invention; a condenser; an expansion device; and an evaporator.

According to the above-described aspects, it is possible to prevent an amorphous carbon layer from being delaminated by having a low-cost structure as a whole when the amorphous carbon layer is formed on a surface of a sliding member of a refrigerant compressor.

DESCRIPTION OF EMBODIMENTS

Hereinafter, embodiments of the present invention will be described with reference to the drawings.

(First Embodiment)

A refrigerating cycle device 1 including a refrigerant compressor according to a first embodiment of the present invention will be described with reference to FIGS. 1 to 5.

Figure 1:
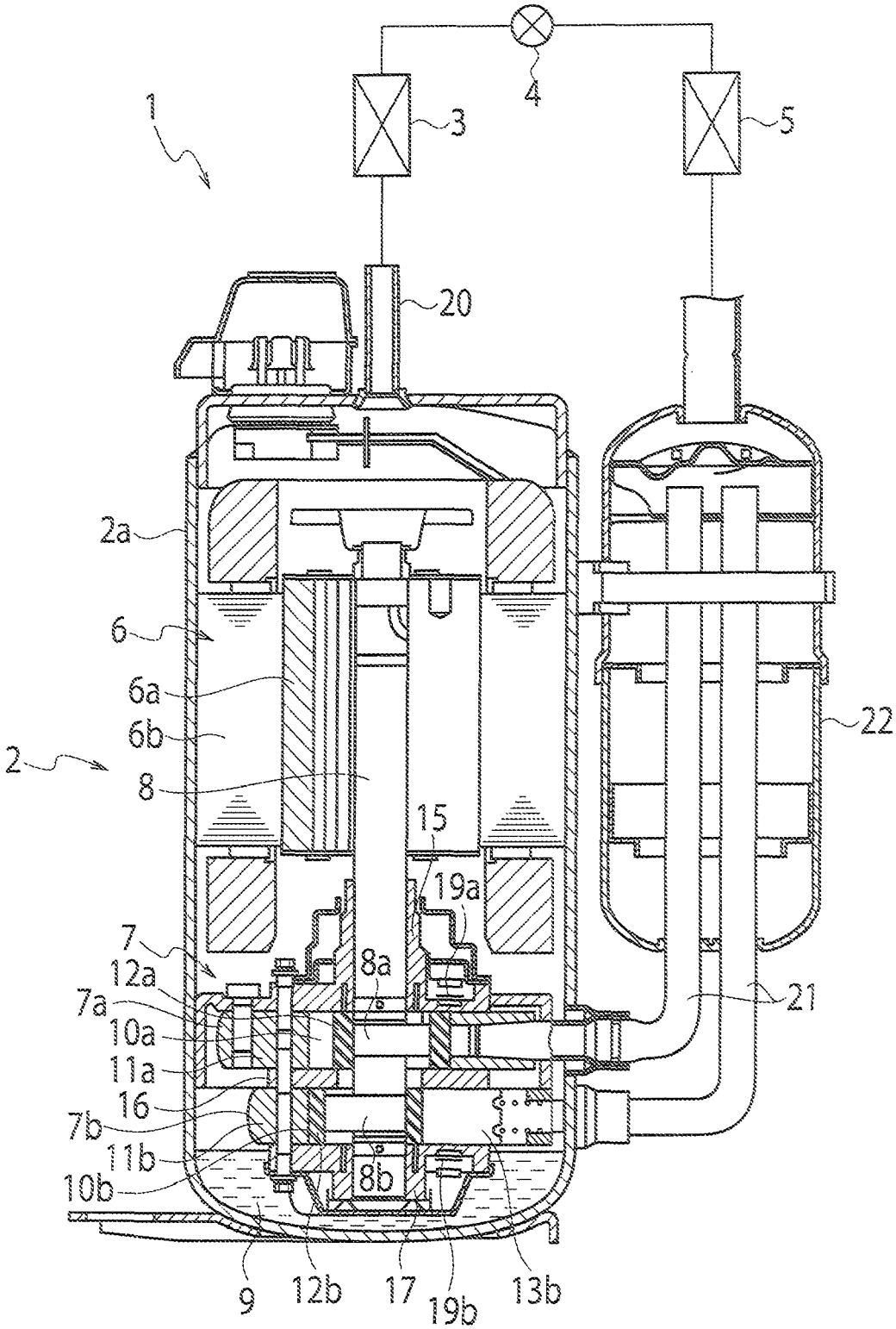
FIG. 1 is a schematic view illustrating a refrigerating cycle device using a refrigerant compressor according to a first embodiment of the present invention.

As illustrated in FIG. 1, the refrigerating cycle device 1 according to a first embodiment of the present invention includes a hermetic type rotary refrigerant compressor 2, a condenser 3, an expansion device 4 and an evaporator 5. The refrigerating cycle device 1 uses an HFC refrigerant, an HC (hydrocarbon-based) refrigerant, or a carbon dioxide refrigerant as a refrigerant. The refrigerant compressor 2 has two cylinders, and includes a sealed case 2*a*. The sealed case 2*a* houses an electric motor 6 and a rotary compression mechanism 7 as a compression mechanism. The electric motor 6 is connected to the rotary compression mechanism 7 via a rotating shaft 8 having a first eccentric member 8*a* and a second eccentric member 8*b*.

The electric motor 6 is composed of a rotor 6*a* and a stator 6*b*. The electric motor 6 may be a brushless DC synchronous motor driven by an inverter, an AC motor, or a motor driven by a commercial power supply.

A refrigerant oil 9 is stored in a bottom of the sealed case 2*a* so as to lubricate the rotary compression mechanism 7. Examples of the refrigerant oil 9 include a single or mixed oil of polyolester oil, ethereal oil, mineral oil, alkylbenzene oil and PAG oil.

The rotary compression mechanism 7 is composed of a first compression mechanism 7*a* and a second compression mechanism 7*b*. The first compression mechanism 7*a* includes a first cylinder 11*a* composing a first cylinder room 10*a*. The second compression mechanism 7*b* includes a second cylinder 11*b* composing a second cylinder room 10*b*. A first roller 12*a* that eccentrically rotates (revolves) is provided in the first cylinder room 10*a*. A second roller 12*b* that eccentrically rotates (revolves) is provided in the second cylinder room 10*b*. A first vane 13*a* is arranged in the first cylinder 11*a*. A second vane 13*b* is arranged in the second cylinder 11*b*. FIG. 1 only illustrates the vane 13*b*. The first vane 13*a* is a sliding member that divides the first cylinder room 10*a* into a suction room and a compression room, and reciprocated being in contact with a periphery of the first roller 12*a*. The second vane 13*b* is a sliding member that divides the second cylinder room 10*b* into a suction room and a compression room, and reciprocated being in contact with a periphery of the second roller 12*b*. Thus, a front edge surface of the first vane 13*a* slides relative to the periphery of the first roller 12*a*, and a side surface of the first vane 13*a* slides relative to a side surface of a first groove 14*a* formed in the first cylinder 11*a*. Similarly, a front edge surface of the second vane 13*b* slides relative to the periphery of the second roller 12*b*, and a side surface of the second vane 13*b* slides relative to a side surface of a second groove 14*b* formed in the second cylinder 11*b* (FIG. 2 only illustrates the groove 14*b*).

The first cylinder room 10*a* of the first compression mechanism 7*a* is covered with a main bearing 15 as a cover and a partition plate 16. The second cylinder room 10*b* of the second compression mechanism 7*b* is covered with an auxiliary bearing 17 as a cover and the partition plate 16. The main bearing 15 is provided with a first discharge hole 18*a* and a first discharge valve 19*a*. The auxiliary bearing 17 is provided with a second discharge hole 18*b* and a second discharge valve 19*b* (the first discharge hole 18*a* and the second discharge hole 18*b* are not illustrated in the figure).

A discharge pipe 20 for discharging compressed refrigerant gas is connected to an upper surface of the sealed case 2*a*. In addition, suction pipes 21 and an accumulator 22 are connected to a lower side portion of the sealed case 2*a*.

Figure 2:
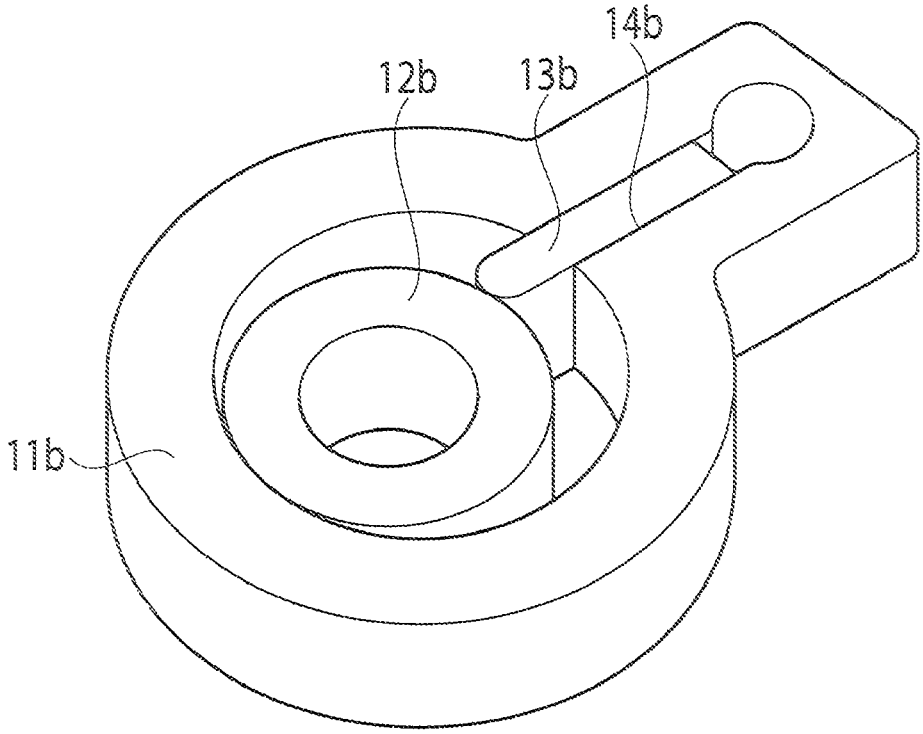
FIG. 2 is a perspective view illustrating a cylinder, roller, and vane composing a part of the refrigerant compressor.

As illustrated in FIG. 2, the second compression mechanism 7*b* includes the second cylinder 11*b*, the second roller 12*b*, the second vane 13*b*, and the like. The first compression mechanism 7*a* has the same configuration as that of the second compression mechanism 7*b*. The first compression mechanism 7*a* includes the first cylinder 11*a*, the first roller 12*a*, the first vane 13*a*, and the like.

Figure 3:
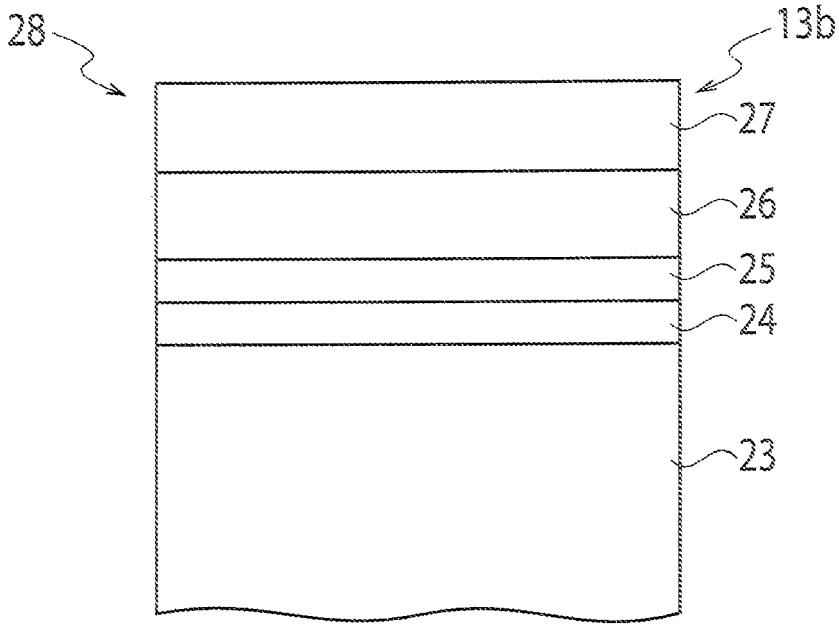
FIG. 3 is a cross-sectional view illustrating a part of a front edge of the vane.

As illustrated in FIG. 3, the vane 13*b* is formed of high-speed tool steel (SKH51) well-tempered so as to have a hardness of HRC 63 as a base material 23. A first layer 24 composed of a single layer of chromium (Cr), a second layer 25 composed of an alloy layer of chromium and tungsten carbide (WC), a third layer 26 composed of an amorphous carbon layer containing tungsten (W), and a fourth layer 27 composed of an amorphous carbon layer containing carbon and hydrogen but not containing metals are sequentially formed on a surface of a top of the base material 23. Note that, the third layer 26 may be composed of an amorphous carbon layer containing tungsten carbide instead of tungsten, or composed of an amorphous carbon layer containing both of tungsten and tungsten carbide.

The second layer 25 is formed to have a chromium content higher on a side of the first layer 24 than a side of the third layer 26, and have a tungsten carbide content higher on the side of the third layer 26 than the side of the first layer 24.

The third layer 26 is formed to have a tungsten content higher on a side of the second layer 25 than a side of the fourth layer 27.

With regard to thicknesses of the respective layers 24, 25, 26 and 27, the first layer 24 has a thickness of 0.2 μm, the second layer 25 has a thickness of 0.3 μm, the third layer 26 has a thickness of 1.25 μm, and the fourth layer 27 has a thickness of 1.25 μm. A coated layer 28 composed of the layers 24 to 27 has a thickness of 3 μm as a whole. In view of reliability of the coated layer 28 composed of the layers 24 to 27, the coated layer 28 preferably has a thickness of 2 to 5 μm.

A surface hardness of the coated layer 28 affects on abrasion characteristics. When the surface hardness of the coated layer 28 is less than HV(0.025)2000, the amorphous carbon layer cannot achieve an effect as a material with a high hardness.

Meanwhile, when the surface hardness of the coated layer 28 is HV(0.025)4000 or more, it may cause abrasion of an opposed material. Therefore, the coated layer 28 preferably has the surface hardness within a range of HV(0.025)2000 to 4000.

Figure 4:
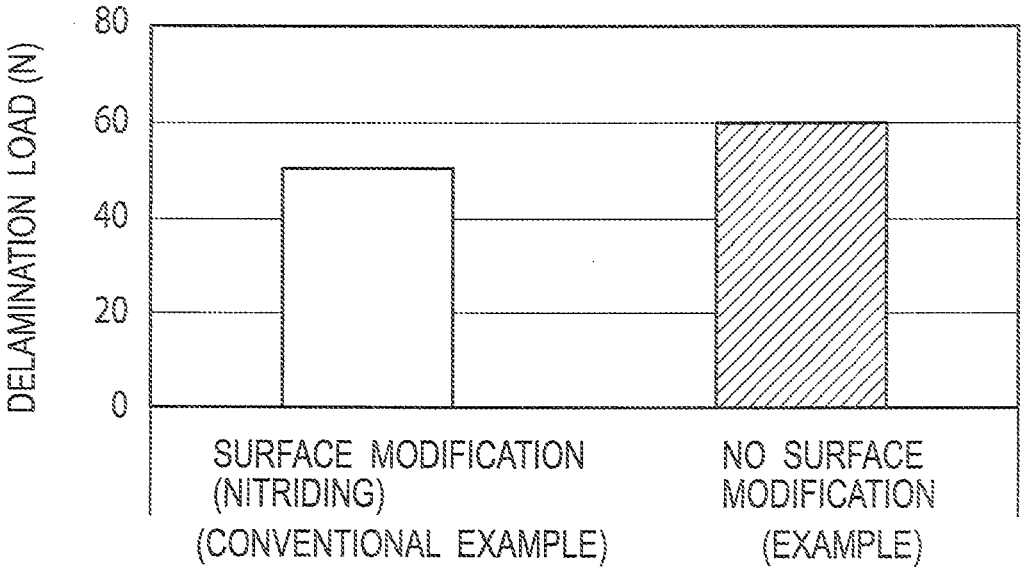
FIG. 4 is a graph illustrating a delamination load of a coated layer by comparison with a conventional example.

FIG. 4 is a graph illustrating a result of a scratching test for a delamination load (critical load) of the coated layer 28 by comparison with a conventional example. The coated layer 28 was formed to have a thickness of 3 .mu.m as described above. A comparative vane of the conventional example to be used was a vane in which a nitriding treatment was performed on its base material so as to have surface modification as described in PTL 1. According to the test result, it was confirmed that the vane 13*b* according to the present embodiment had the larger delamination load than the vane of the conventional example, and further confirmed that the nitride layer was not required to be formed on the surface of the base material of the vane, which had been required in the conventional example.

Figure 5:
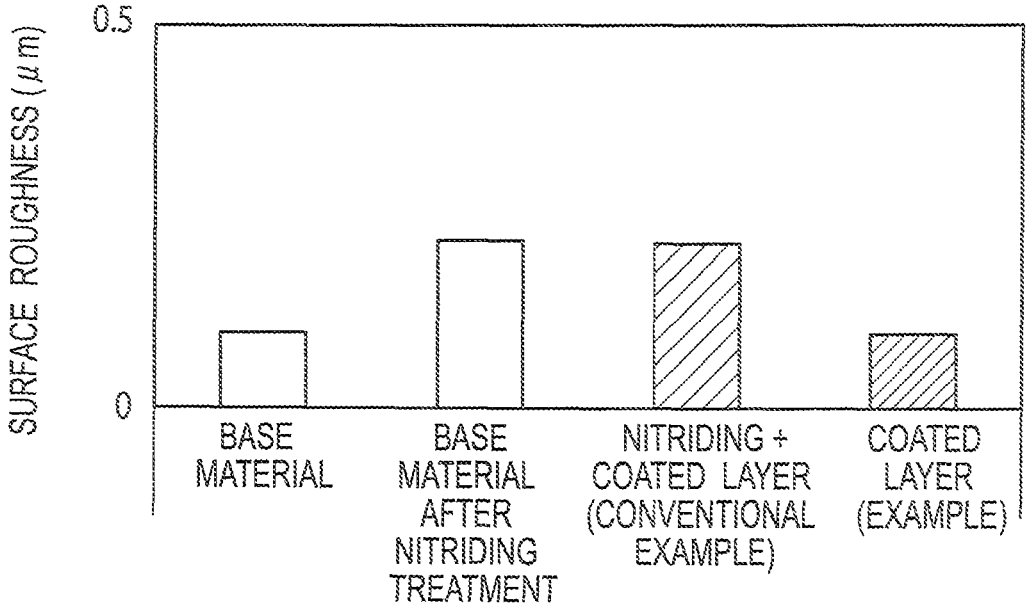
FIG. 5 is a graph illustrating surface roughness of a coated layer by comparison with a conventional example.

FIG. 5 is a graph illustrating a measurement result of surface roughness of the coated layer 28 by comparison with the conventional example. This measurement was performed on the vane 13*b* formed with the coated layer 28 thereon according to the present embodiment, a base material of the vane used in the conventional example, a base material of the vane used in the conventional example on which a nitriding treatment was performed, and the vane of the conventional example that was formed with a coated layer composed of an intermediate layer and an amorphous carbon layer after the nitriding treatment. The nitriding treatment was performed by a method without producing a nitrogenous compound layer. According to the conventional example, it was confirmed that surface roughness of a base material of a vane was harshened by a nitriding treatment, and such a surface roughness was maintained even after a coated layer was formed. On the other hand, it was confirmed that surface roughness of the vane 13*b* according to the present embodiment was improved.

As described above, according to the first embodiment, the first layer 24, the second layer 25, the third layer 26, and the fourth layer 27 are sequentially formed on the surface of the base material 23 of the vane 13*b* composed of high-speed tool steel. The first layer 24 is composed of a single layer of chromium, the second layer 25 is composed of an alloy layer of chromium and tungsten carbide, the third layer 26 is composed of a metal-containing amorphous carbon layer containing at least one of tungsten and tungsten carbide, and the fourth layer 27 is composed of an amorphous carbon layer containing carbon and hydrogen but not containing metals. In addition, the second layer 25 is formed to have a chromium content higher on the side of the first layer 24 than the side of the third layer 26, and have a tungsten carbide content higher on the side of the third layer 26 than the side of the first layer 24. Moreover, the third layer 26 is formed to have a tungsten content or a tungsten carbide content higher on the side of the second layer 25 than the side of the fourth layer 27.

Thus, the first layer 24 is a chrome layer that has high adhesiveness to the base material 23. Furthermore, the hardness differences between the first layer 24 and the second layer 25, between the second layer 25 and the third layer 26, and between the third layer 26 and the fourth layer 27 are reduced. Accordingly, adhesiveness between the respective layers can be improved, and the coated layer 28 including the fourth layer (amorphous carbon layer) 27 and the fourth layer 27 can be prevented from being delaminated from the vane 13*b*.

In addition, the nitride layer as described in the conventional example is not required to be formed on the base material 23 of the vane 13*b*, and there is no operation for forming the nitride layer formed by a different process from the forming processes of the first layer 24 to the fourth layer 27. As a result, the vane can be composed of a low-cost structure.

Moreover, no nitriding treatment is performed on the base material 23 of the vane 13*b*. Accordingly, surface roughness of the base material 23 can be prevented from being worsened with the nitriding treatment, and the surface of the fourth layer 27 can be smoothed.

Although the present embodiment was described with the example that the high-speed tool steel (SKH51) was used for the base material 23 of the vane 13*b*, carbon tool steel or alloy tool steel may be used instead of the high-speed tool steel.

(Second Embodiment)

A refrigerant compressor according to a second embodiment of the present invention will be described with reference to FIGS. 6 to 8. The fundamental constitution of the refrigerant compressor according to the second embodiment is the same as the fundamental constitution of the refrigerant compressor 2 according to the first embodiment. Thus, the constitution of the refrigerant compressor according to the second embodiment will be explained with reference to FIG. 1.

The refrigerant compressor according to the second embodiment uses the refrigerant oil 9, especially, uses polyolester oil in which 0.5% by weight of phosphate esters and 0.5% by weight of sulfur-based compounds are added to the refrigerant oil 9 as load carrying additive. The other constitutions of the second embodiment are the same as those of the first embodiment.

Figure 6:
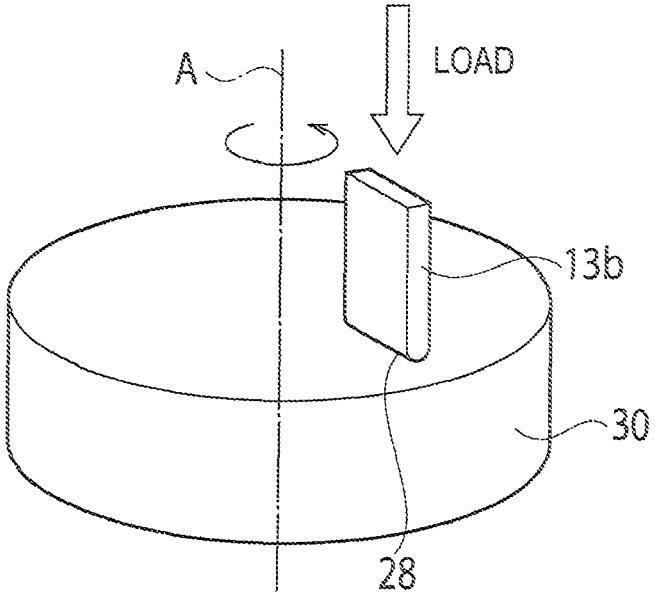
FIG. 6 is a perspective view illustrating a device for measuring abrasion volume of a coated layer of a vane according to a second embodiment of the present invention.
Figure 7:
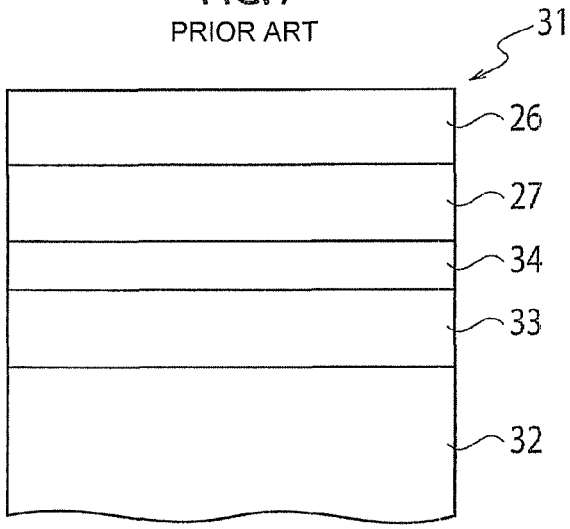
FIG. 7 PRIOR ART
FIG. 7 is a cross-sectional view illustrating a part of a front edge of a comparative conventional vane.

In order to measure abrasion volume of the coated layer 28 in the case of adding the load carrying additive to the refrigerant oil 9 and in the case of not adding the load carrying additive to the refrigerant oil 9, the measurement was performed by use of a device illustrated in FIG. 6. In this measurement, a disk 30 formed of the high-speed tool steel is immersed in the refrigerant oil 9 to which the load carrying additive is added. Then, the part, in which the coated layer 28 was formed in the vane 13*b*, was brought into contact with the disk 30 with a constant load (for example, 300 newtons). Meanwhile, the disk 30 was rotated around a central line A at a constant speed (for example, 716 rpm) in an arrow direction, so as to measure the abrasion volume of the coated layer 28. The measurement was continued for one hour. The same test was performed on a vane 31 of the conventional example. As illustrated in FIG. 7, the vane 31 of the conventional example used in the test is diffusionally formed with a nitride layer 33 on a surface of a base material 32 of the vane 31, formed with an intermediate layer 34 thereon, formed with the amorphous carbon layer 27 containing carbon and hydrogen but not containing metals (corresponding to the fourth layer of the present embodiment) thereon, and formed with the amorphous carbon layer 26 containing tungsten (corresponding to the third layer of the present embodiment) thereon.

Figure 8:
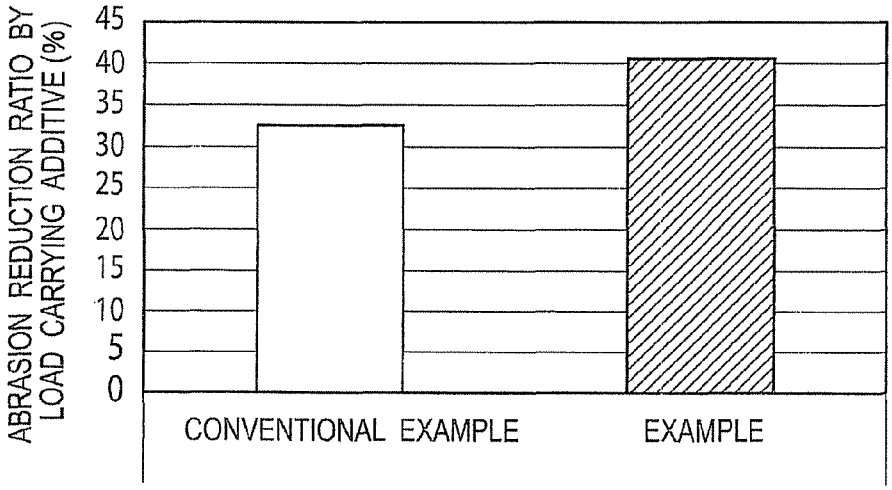
FIG. 8 is a graph illustrating an abrasion reduction ratio when load carrying additive is added to refrigerant oil.

FIG. 8 is a graph illustrating a test result, which represents a reduction ratio with respect to the abrasion volume of the coated layer 28 when the similar test to the above-described one was performed in the refrigerant oil 9 to which the load carrying additive was not added. According to the graph in FIG. 8, it was confirmed that the vane 13*b* according to the present embodiment had a higher reduction ratio of the abrasion volume of the coated layer 28 compared with the vane 31 of the conventional example when the load carrying additive was added to the refrigerant oil 9.

As described above, in the second embodiment, the vane 13*b* is used in the refrigerant oil 9 to which the load carrying additive is added, in which the first layer 24 to the fourth layer 27 are sequentially formed on the base material 23 of the vane 13*b* as described in the first embodiment. Due to such a configuration, the effect of the load carrying additive can be highly exerted. Furthermore, the abrasion volume of the coated layer 28 can be reduced compared with the vane 31 of the conventional example used in the refrigerant oil 9 to which the load carrying additive is added.

(Third Embodiment)

A refrigerant compressor according to a third embodiment of the present invention will be described with reference to FIG. 9. The fundamental constitution of the refrigerant compressor according to the third embodiment is the same as the fundamental constitution of the refrigerant compressor 2 according to the first embodiment. Thus, the constitution of the refrigerant compressor according to the third embodiment will be explained with reference to FIGS. 1 and 2. In addition, a device used for measuring the abrasion volume in the third embodiment is the device illustrated in FIG. 6.

In order to measure the abrasion volume of the coated layer 28 of the vane 13*b* while sliding in contact with the roller 12*b*, the measurement was performed by use of the device illustrated in FIG. 6. Particularly, the device in which the disk 30 was formed of the high-speed tool steel (SKH51) and the device in which the disk 30 was formed of spheroidal graphite cast iron (FCD600) were employed for the measurement.

Figure 9:
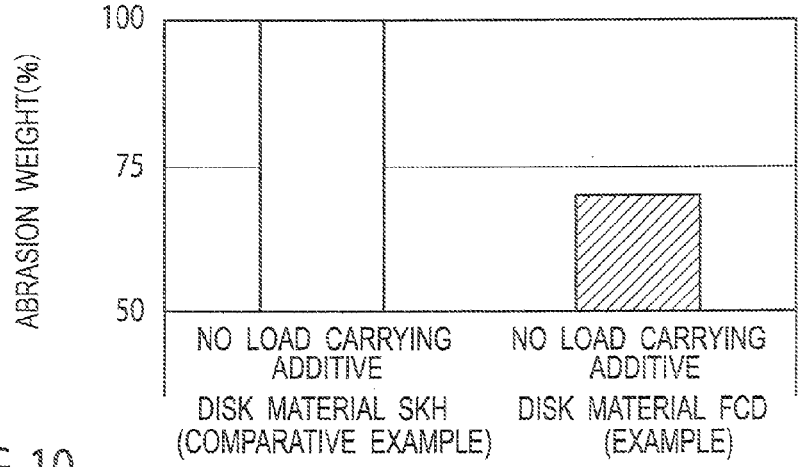
FIG. 9 is a graph illustrating abrasion volume of a coated layer according to a third embodiment of the present invention, in which the abrasion volume of the coated layer is lowered when an opposed material with which a vane comes in contact is spheroidal graphite cast iron.

FIG. 9 is a graph illustrating a change in the abrasion volume of the coated layer 28 according to opposed materials with which the vane 13*b* comes in contact. The measurement of the abrasion volume was performed by immersing the disk 30 in the refrigerant oil 9 to which the load carrying additive was not added, so as to compare the abrasion volume of the coated layer 28 of the vane 13*b* when the disk 30 was formed of the high-speed tool steel with the abrasion volume of the coated layer 28 of the vane 13*b* when the disk 30 was formed of the spheroidal graphite cast iron. When the abrasion volume of the coated layer 28 of the vane 13*b* when the disk 30 was formed of the high-speed tool steel was represented by 100%, the abrasion volume of the coated layer 28 of the vane 13*b* when the disk 30 was formed of the spheroidal graphite cast iron was approximately 70%.

Even when the disk 30 was formed of flake graphite cast iron (FC), the similar result to the case of being formed of the spheroidal graphite cast iron could be achieved. In addition, the similar effect could be achieved in other cast iron in which elements such as vanadium (V), phosphorus (P), molybdenum (Mo), nickel (Ni), chromium (Cr), and copper (Cu) were added to the spheroidal graphite cast iron or the flake graphite cast iron.

As described above, according to the third embodiment, the roller 12*b* as an opposed material that the vane 13*b* slides relative to is formed of the spheroidal graphite cast iron or the flake graphite cast iron. Due to such a configuration, the abrasion volume of the coated layer 28 of the vane 13*b* can be reduced even if the load carrying additive is not added to the refrigerant oil 9.

(Fourth Embodiment)

A refrigerant compressor according to a fourth embodiment of the present invention will be described with reference to FIG. 10. The fundamental constitution of the refrigerant compressor according to the fourth embodiment is the same as the fundamental constitution of the refrigerant compressor 2 according to the first embodiment. Thus, the constitution of the refrigerant compressor according to the fourth embodiment will be explained with reference to FIGS. 1 and 3.

The refrigerant compressor 2 according to the first embodiment was described with the example that the third layer 26 and the fourth layer 27 both had the thickness of 1.25 μm as illustrated in FIG. 3. On the other hand, the thickness of the third layer 26 and the thickness of the fourth layer 27 were different from each other in the fourth embodiment.

Figure 10:
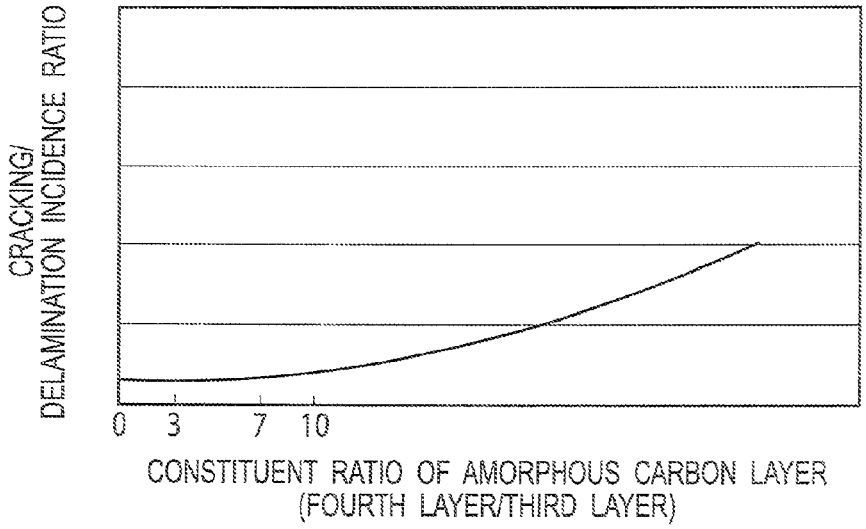
FIG. 10 is a graph illustrating a cracking/delamination incidence ratio of a coated layer according to a fourth embodiment of the present invention, in which the cracking/delamination incidence ratio of the coated layer is lowered by increasing a thickness of a fourth layer than a thickness of a third layer.

FIG. 10 is a graph illustrating a constituent ratio (the fourth layer 27/the third layer 26) of the amorphous layers (the third layer 26 and the fourth layer 27), and a tendency of impact resistance (incidence of cracking/exfoliation) of the coated layer 28.

The impact resistance of the coated layer 28 represents an incidence tendency of cracking or delamination of the coated layer 28 under a specific condition in which the vane. 13*b* collides with the roller 12*b* severely in the refrigerant compressor 2, such as a condition in which the test is performed by intentionally causing a liquid refrigerant to be absorbed intermittently with a high compression ratio.

According to the graph in FIG. 10, it was confirmed that cracking or delamination of the coated layer 28 of the vane 13*b* could be prevented during the activation of the refrigerant compressor 2 by setting the constituent ratio (the fourth layer 27/the third layer 26) of the amorphous layers (the third layer 26 and the fourth layer 27) to more than 1 to 10 or less, more preferably 3 to 7.

(Fifth Embodiment)

Figure 11:
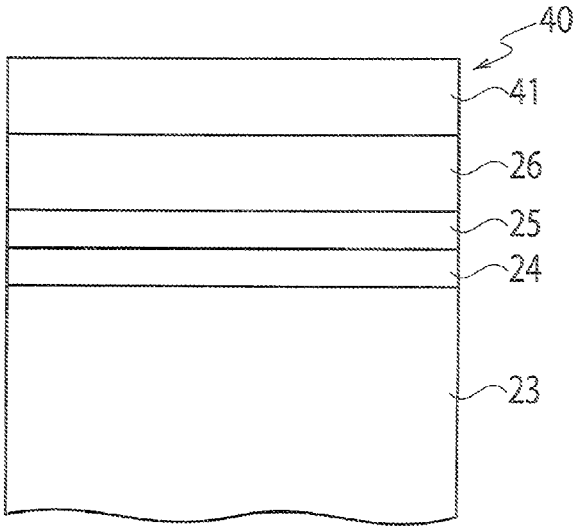
FIG. 11 is a cross-sectional view illustrating a part of a front edge of a vane according to a fifth embodiment of the present invention.

A vane 40, as a sliding member, of a refrigerant compressor according to a fifth embodiment of the present invention will be described with reference to FIG. 11. The fundamental constitution of the refrigerant compressor according to the fifth embodiment except for the vane 40 is the same as the fundamental constitution of the refrigerant compressor 2 according to the first embodiment. Thus, the constitution of the refrigerant compressor according to the fifth embodiment will be explained with reference to FIG. 1.

The vane 40 in the refrigerant compressor according to the fifth embodiment is formed of the high-speed tool steel (SKH51) well-tempered so as to have a hardness of HRC 63 as a base material 23. The first layer 24 composed of a single layer of chromium, the second layer 25 composed of an alloy layer of chromium and tungsten carbide, the third layer 26 composed of an amorphous carbon layer containing tungsten, and a fourth layer 41 composed of an amorphous carbon layer containing silicon (Si) are sequentially formed on a surface of the base material 23.

The second layer 25 is formed to have a chromium content higher on a side of the first layer 24 than a side of the third layer 26, and have a tungsten carbide content higher on the side of the third layer 26 than the side of the first layer 24.

The third layer 26 is formed to have a tungsten content higher on a side of the second layer 25 than a side of the fourth layer 41.

With regard to the thicknesses of the respective layers 24, 25, 26 and 41, the first layer 24 has the thickness of 0.2 μm, the second layer 25 has the thickness of 0.3 μm, the third layer 26 has the thickness of 1.75 μm, and the fourth layer 41 has the thickness of 1.75 μm. Thus, the total thickness of those layers is to be 4 μm.

Silicon carbide (SiC) to be formed by containing silicon has a high heat resistance property. Therefore, the vane 40 including the fourth layer 41 composed of the amorphous carbon layer containing silicon can be prevented from causing the fourth layer 41 to be damaged due to high temperature.

INDUSTRIAL APPLICABILITY

In the refrigerant compressor and the refrigerating cycle device of the present invention, the coated layer including the amorphous carbon layer having high abrasion resistance and adhesiveness and hard to be delaminated can be formed in the sliding member with a low-cost structure. Accordingly, the present invention can provide the high-performance and low-cost refrigerant compressor and refrigerating cycle device.

What is claimed is:

1. A refrigerant compressor comprising a compression mechanism that compresses a refrigerant used in refrigerating cycle, the compression mechanism including a plurality of sliding members, wherein:

at least one of the plurality of sliding members in the compression mechanism is formed of tool steel;

a first layer comprising a single layer of chromium, a second layer comprising an alloy layer of chromium and tungsten carbide, a third layer consisting essentially of a metal-containing amorphous carbon layer wherein the metal is selected from the group consisting of tungsten and tungsten carbide, and a fourth layer comprising an amorphous carbon layer containing carbon and hydrogen without metals are sequentially formed on a surface of the at least one of the plurality of sliding members;

the second layer is formed to have a chromium content higher on a side of the first layer than a side of the third layer, and have a tungsten carbide content higher on the side of the third layer than the side of the first layer; and the third layer is formed to have a tungsten content or a tungsten carbide content higher on a side of the second layer than a side of the fourth layer; and a thickness of the fourth layer is larger than a thickness of the third layer.

2. The refrigerant compressor of claim 1, wherein a phosphorus-based or sulfur-based load carrying additive is added to refrigerant oil for lubricating the compression mechanism.

3. The refrigerant compressor of claim 1, wherein an opposed material that the at least one of the plurality of sliding members slides relative to is spheroidal or flake graphite-like cast iron.

4. The refrigerant compressor of claim 1, wherein the fourth layer formed on the surface of the at least one of the plurality of sliding members contains at least one of silicon and silicon carbide.

5. A refrigerating cycle device, comprising:

a refrigerant compressor comprising a compression mechanism that compresses a refrigerant used in refrigerating cycle, the compression mechanism including a plurality of sliding members, wherein at least one of the plurality of sliding members in the compression mechanism is formed of tool steel, a first layer comprising a single layer of chromium, a second layer comprising an alloy layer of chromium and tungsten carbide, a third layer consisting essentially of a metal-containing amorphous carbon layer wherein the metal is selected from the group consisting of tungsten and tungsten carbide, and a fourth layer comprising an amorphous carbon layer containing carbon and hydrogen without metals are sequentially formed on a surface of the at least one of the plurality of sliding members, the second layer is formed to have a chromium content higher on a side of the first layer than a side of the third layer, and have a tungsten carbide content higher on the side of the third layer than the side of the first layer, and the third layer is formed to have a tungsten content or a tungsten carbide content higher on a side of the second layer than a side of the fourth layer; and a thickness of the fourth layer is larger than a thickness of the third layer;

a condenser;

an expansion device; and an evaporator.

6. The refrigerating cycle device of claim 5, wherein a phosphorus-based or sulfur-based load carrying additive is added to refrigerant oil for lubricating the compression mechanism.

7. The refrigerating cycle device of claim 5, wherein an opposed material that the at least one of the plurality of sliding members slides relative to is spheroidal or flake graphite-like cast iron.

8. The refrigerating cycle device of claim 5, wherein the fourth layer formed on the surface of the at least one of the plurality of sliding members contains at least one of silicon and silicon carbide.

* * * * *